United States Patent [19]

Wada et al.

[11] Patent Number: 4,897,131

[45] Date of Patent: Jan. 30, 1990

[54] GRAIN-ORIENTED ELECTRICAL STEEL SHEET HAVING IMPROVED GLASS FILM PROPERTIES AND LOW WATT LOSS

[75] Inventors: Toshiya Wada; Osamu Tanaka; Toshihiko Takata; Kunihide Takashima; Hiromichi Yasumoto, all of Kitakyushu, Japan

[73] Assignee: Nippon Steel Corporation, Tokyo, Japan

[21] Appl. No.: 938,648

[22] Filed: Dec. 5, 1986

[30] Foreign Application Priority Data

| | | | |
|---|---|---|---|
| Dec. 6, 1985 | [JP] | Japan | 60-273421 |
| Dec. 26, 1985 | [JP] | Japan | 60-292134 |
| Dec. 26, 1985 | [JP] | Japan | 60-292135 |
| Dec. 26, 1985 | [JP] | Japan | 60-292136 |
| Dec. 27, 1985 | [JP] | Japan | 60-293281 |
| Oct. 11, 1986 | [JP] | Japan | 61-240182 |
| Oct. 11, 1986 | [JP] | Japan | 61-240183 |

[51] Int. Cl.[4] ..... H01F 1/04

[52] U.S. Cl. ..... 148/308; 148/307; 148/113

[58] Field of Search ..... 148/307, 308, 111, 113

[56] References Cited

U.S. PATENT DOCUMENTS

| | | | |
|---|---|---|---|
| 2,234,968 | 3/1941 | Hayes et al. | 175/356 |
| 4,213,804 | 7/1980 | Datta | 148/113 |
| 4,363,677 | 12/1982 | Ichiyama et al. | 148/111 |

FOREIGN PATENT DOCUMENTS

| | | | |
|---|---|---|---|
| 1198036 | 12/1985 | Canada | 148/308 |
| 0074715 | 3/1983 | European Pat. Off. . | |
| 0099619 | 2/1984 | European Pat. Off. . | |

OTHER PUBLICATIONS

Patent Abstracts of Japan, vol. 6, No. 186, (C-126)(1064), Sep. 22, 1982 corresponding to Japan No. 57-101673 dated Jun. 24, 1982.

Patent Abstracts of Japan, vol. 10, No. 276 (C-373)(2332) Sep. 19, 1986 corresponding to Japan No. 61-96082 dated May 14, 1982.

*Primary Examiner*—John P. Sheehan

*Attorney, Agent, or Firm*—Kenyon & Kenyon

[57] ABSTRACT

The adhesiveness of a glass film and watt loss of a grain-oriented electrical steel sheet is improved by partially protruding the glass film into the steel sheet part thereof. To attain the partial protrusion, the steel sheet is subjected, prior or subsequent to decarburization annealing, to a treatment of the surface thereof to form unevenness, by a mechanical device, e.g., brush rolling, buff polishing, marking-off, sand papering, and grinding.

5 Claims, 10 Drawing Sheets

(X 2000)

(X 2000)

(X 2000)

GRAIN-ORIENTED ELECTRICAL STEEL SHEET HAVING IMPROVED GLASS FILM PROPERTIES AND LOW WATT LOSS

BACKGROUND OF THE INVENTION

1. Field of the Invention

The present invention relates to a grain-oriented electrical steel sheet having improved glass film properties and a low watt loss, and a process for producing the same.

2. Description of the Related Arts

Grain-oriented electrical steel sheet is mainly used for the cores of electrical appliances, such as transformers and power generators. For such usage, it is important that the grain-oriented electrical steel sheet have excellent magnetic properties such as the watt-loss characteristics and excitation characteristics, and excellent glass film properties. Usually, the grain-oriented electrical steel sheet is produced by the steps of hot-rolling a silicon-steel slab containing 4% or less of silicon, and if necessary, hot-coil annealing; cold-rolling once or twice or more with an intermediate annealing therebetween to obtain a cold-rolled sheet having a final sheet thickness; decarburization-annealing; applying an annealing separator mainly composed of MgO; finishing annealing to develop secondary recrystallized grains having a Goss texture; removing impurities such as S and N; forming a glass film; and finally, heat-flattening and treating with an insulating coating.

An improvement of the magnetic properties, particularly the watt loss, together with an improvement of the glass film has been investigated, and it is known, as shown in J. Appl. Phys. 38, (1967), pp. 1104 ~1108, that a reduction in the sheet thickness and grain-refinement of a grain-oriented electrical steel sheet effectively reduces the watt loss. Reducing the sheet gauge is an effective method of reducing the watt loss, but the watt loss is increased due to an increase in the eddy current loss when the sheet thickness becomes less than a predetermined thickness. An improvement of the watt loss by grain-refinement is inherently limited by the secondary recrystallization phenomenon, which is utilized to attain a growth of grains having the Goss texture and enhance the orientation degree.

For an improvement of a glass film, Japanese Unexamined Patent Publication (Kokai) No. 50-71526, for example, describes the pickling of a grain-oriented electrical steel sheet, which was cold-rolled to a final thickness, in such a manner that 3 $g/m^2$ or more of its surface layer is uniformly removed, thereby removing the surface deposits and a superficial part of the steel part thereof, and thus enabling a uniform progression in the decarburization reaction and the oxide-formation reaction. This, in turn, leads to a formation of an $MgO\text{-}SiO_2$ series insulating film having an improved uniformity and adhesiveness after the decarburization annealing, application of an annealing separator, and finishing annealing.

Japanese Unexamined Patent Publication (Kokai) No. 57-101673 discloses that, after the decarburization annealing of a grain-oriented electrical steel strip cold-rolled to a final thickness and before the application of the annealing separator, such as MgO and the like, the surface of the steel strip is subjected to grinding or pickling so as to remove 0.025 to 0.5 $g/m^2$ of the surface per one side, thereby removing the oxide film constituting the surface layer of a grain-oriented electrical steel sheet. Subsequently, the annealing separator is applied, and finishing annealing is carried out. The thus-formed glass film has a uniform, grey appearance, and an improved adhesiveness.

Japanese Unexamined Patent Publication (Kokai) No. 61-96082 proposes to grind and clean the surface of a steel sheet, without forming unevennesses, by a grinding means consisting of soft materials including a carborundum abrasive and an alundum abrasive, thereby enabling a uniform subscale of $SiO_2$ to be formed during the decarburization annealing and a uniform and dense film to be formed during the finishing annealing.

SUMMARY OF THE INVENTION

The prior methods attained improvements in the glass film properties, such as adhesiveness, and in the magnetic properties, but are not satisfactory.

When improvements in the glass film properties are attempted by thickening the film, this can be effectively attained by thickening the oxide layer consisting mainly of $SiO_2$ in the decarburization annealing. In this case, measures such as enhancing the $P\ H_2O/P\ H_2$ and elongating the soaking time become necessary. These measures inevitably lead to an increase in the amount of Fe series oxide formed, such as fayallite ($Fe_2SiO_4$), FeO, and the like, and thus to a degradation of the qualities of a glass film and an adverse influence on the inhibitors. Particularly, the high Si materials for improving the magnetic properties, especially reducing the watt loss, and materials with a special additive-composing element or compound as inhibitors, are concentrated in the surface layer or are selectively oxidized, with the result that a decarburization failure may occur or the formation of a decarburization-oxidized film may be impaired.

SUMMARY OF THE INVENTION

An object of the present invention is to provide a grain-oriented electrical steel sheet having improved glass film properties and a low watt loss, and a process for producing the same.

Another object of the present invention is to provide a method for producing a grain-oriented electrical steel sheet having improved glass film properties and a low watt loss, and a process for producing the same.

A further object of the present invention is to provide a method for producing a grain-oriented electrical steel sheet, which method enables an improvement in the glass film properties and a reduction of the watt loss of high Si materials and materials with special additives, these materials being difficult to produce with a high productivity by the prior art methods.

The present inventors discovered that, when an oxide is formed in such a way that it partially protrudes into the steel sheet part or side of a grain-oriented electrical steel sheet, an anchoring effect is generated, thereby dramatically improving the adhesiveness of a glass film and greatly enhancing the tension effect of a film. The discoveries made by the present inventors are hereinafter described in detail.

The present inventors carried out investigations into the influence of the shapes of the oxide layer formed on the steel sheet during the decarburization annealing, and of the glass film formed due to the reactions between the oxide layer and annealing separator, upon the adhesiveness of a glass film, tension at the steel sheet, and the watt loss. The layer, which is constituted at the steel sheet part or side by an oxide(s) of either $SiO_2$- enriched Fe oxide, an ordinary oxide, or an oxide partially containing forsterite, is hereinafter referred to as the inner oxide layer.

In accordance with the present invention, there is provided a grain-oriented electrical steel sheet having a glass film on the steel part thereof, characterized by forming an oxide partially protruding into the steel part, thereby improving the adhesiveness of the glass film and the watt loss.

There is also provided a method for producing a grain-oriented electrical steel sheet having improved glass film adhesiveness and an improved watt loss, comprising the steps of hot-rolling a silicon-steel slab; annealing; cold-rolling once or twice or more with an intermediate annealing therebetween; decarburization-annealing; applying an annealing separator; and finishing annealing in which a glass film is formed on the silicon steel sheet, characterized by subjecting the steel sheet, prior or subsequent to the decarburization annealing, to a treatment of the surface thereof so as to form unevenesses, concave parts of which provide sites at which oxide is protruded into the silicon steel part during the finishing annealing or during the decarburization annealing and the finishing annealing.

DESCRIPTION OF THE PREFERRED EMBODIMENTS

Figure 1A:
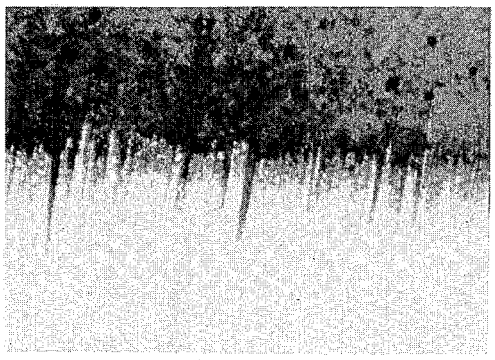
FIGS. 1(A) and (B) are metal-microscope photographs of the inner oxide layers formed by the method of the present invention and by the comparative method, respectively.
Figure 1B:
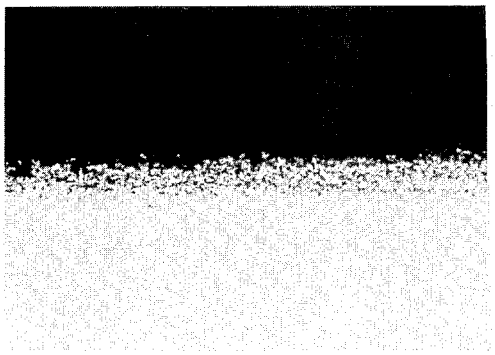
Figure 2:
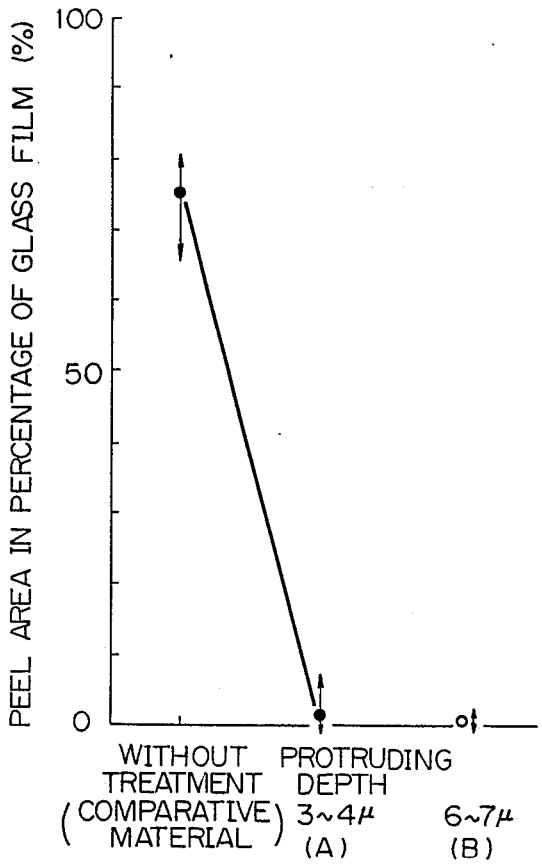
FIG. 2 illustrates the influence exerted by depth of the protrusion of the inner oxide layer upon the adhesiveness of a glass film.
Figure 3:
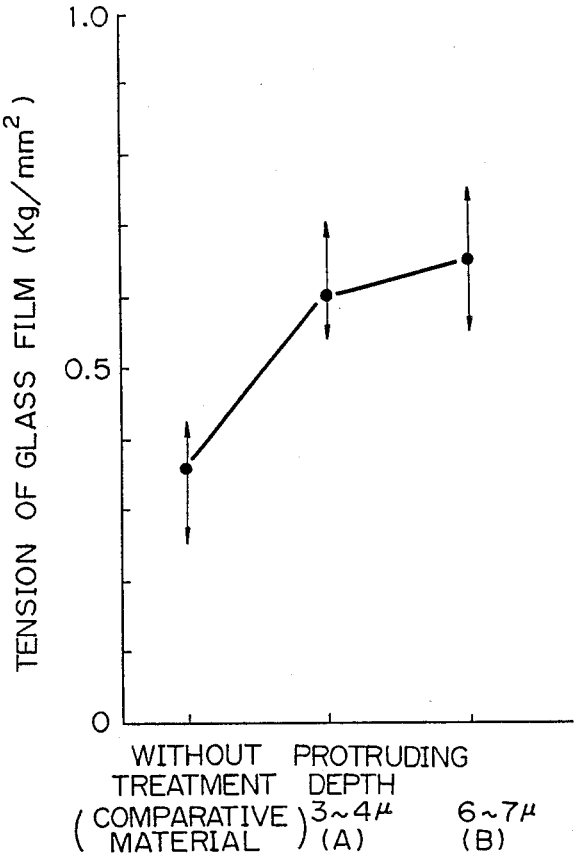
FIG. 3 illustrates the influence exerted by the depth of protrusion of the inner oxide layer upon the tension of the steel sheet.
Figure 4:
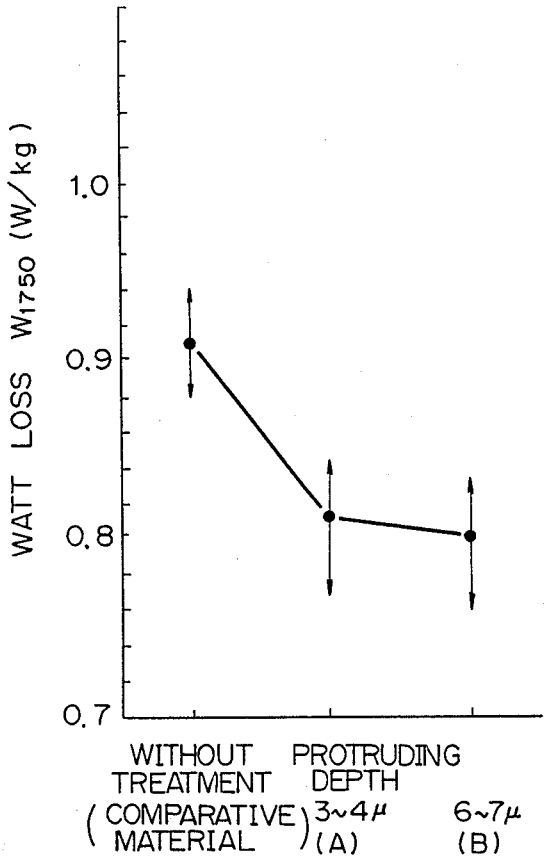
FIG. 4 illustrates the influence exerted by the depth of protrusion of the inner oxide layer upon the watt loss.

In an experiment by the present inventors, the surfaces of cold-rolled steel sheets of grain-oriented electrical steel, which were cold-rolled to a thickness of 0.225 mm, were polished by sheets of sandpaper having different grades to form sharp and minute unevennesses, and then decarburization annealed to form the depth and shapes of the inner oxide layer. Subsequently, an annealing separator mainly composed of MgO was applied and finishing annealing was carried out. The inner oxide layer was, as shown in FIG. 1(B), virtually uniformly thick on steel which had not been polished. Conversely, on steel which had been polished, parts of the inner oxide layer were thicker than the average thickness, and were thick enough to protrude into the steel sheet side. The adhesiveness of the glass film was tested, after the application of the annealing separator and then finishing annealing, by bending to around 10 mmϕ, i.e., more severe than the usual condition of bending to around 20~50 mmϕ, to investigate the peel area percentage of the glass film. The results are shown in FIG. 2. In the samples A and B, in which the formed inner oxide layer partially protrudes into the steel sheet side, no peeling occurs and the adhesiveness is extremely good. In addition, the tension imparted to the steel sheet is greatly increased, as shown in FIG. 3. FIG. 4 shows that the watt loss is greatly decreased to attain a low watt loss.

When a deep inner oxide layer was formed, the glass film formed by the finishing annealing was also deep. The unevenesses do not lead to refinement of secondary recrystallized grains at parts of a grain-oriented electrical steel sheet where the unevenesses are formed.

The present invention was completed based on the discoveries as described above and in more detail hereafter.

In the present invention, preferably the inner oxide layer partially protrudes into the steel sheet side of a grain-oriented electrical steel sheet by a depth of approximately 2 to 15 μm, exceeding the average thickness thereof. The term "partially" herein indicates a continuous or discontinuous state of an inner oxide layer having protruding parts at an equal-distance or non-equi distance.

Preferably, the above mentioned surface treatment is carried out prior to the decarburization-annealing, by an optical means, particularly irradiation of laser, e.g., YAG or $CO_2$ laser, and/or a mechanical means, particularly brush rolling, buff polishing, marking-off, sand papering, and grinding, and further, sharp and minute unevennesses are formed by the mechanical and/or optical means on the entire surface of the steel sheet within ±30 degrees to the direction perpendicular to the rolling direction, and at a distance of less than 1 mm. The surface treatment is carried out on either or both of the surfaces of the sheet to form the unevennesses on at least 35%, preferably 50%, by area of the steel sheet. The surface of the steel sheet is activated due to this formation of unevennesses, and a thick oxide is formed during the decarburization annealing and finishing annealing and protrudes into the steel sheet via the activated parts.

The $SiO_2$ is enriched in the oxide formed during the decarburization annealing and finishing annealing due to the activating, with the result that the glass film properties are improved, and further, the steel sheet is shielded from the atmosphere during the finishing annealing, thereby suppressing reaction between the inhibitors, such as MnS and AlN, and the annealing atmosphere, and stably maintaining them to a high temperature. Therefore, a stable secondary recrystallization takes place.

The $SiO_2$ enriched layer tends to impede decarburization and may lead to a degradation of the watt loss. Therefore, it is necessary to provide annealing conditions more favourable than those of the conventional method without the activation. The annealing conditions are a temperature of 800° ~ 860° C., on atmosphere of $N_2$, $H_2$, or a mixture of $N_2+H_2$, and a P $H_2O$/P $H_2 \geqq 0.40$.

When sharp and minute unevennesses are formed, the surface layer of the steel sheet is removed by an amount of generally 2.0 g/m$^2$ or more, which is greater than the amount of from 0.025 to 0.5 g/m$^2$ incurred when removing the oxide film on the surface of a steel sheet as described in Japanese Unexamined Patent Publication (Kokai) No. 57-101673. Therefore, the yield is a little decreased in the present invention, but this is negligible in the light of the dramatic improvement in the glass film properties and watt loss characteristics.

A further reduction of the watt loss is attained by setting the distance between adjacent sharp and minute unevennesses to an extremely narrow distance of less than 1 mm, and orienting them to within ±30 degrees relative to the direction perpendicular to the rolling direction. The unevennesses should be formed before the completion of the decarburization annealing, preferably before starting the decarburization annealing or during the temperature-elevation period in the decarburization annealing process.

Note, it is known to form minute marks, such as linear flaws, on a grain-oriented electrical steel sheet with a space between the marks, so as to subdivide the magnetic domains. The formation distance of the marks is allegedly more than 1 mm, but in practice, is from 3 to 12 mm. Allegedly, the watt loss increases at a minute mark distance of less than 1 mm when subdividing the magnetic domains, contrary to the case of the present invention.

Figure 5:
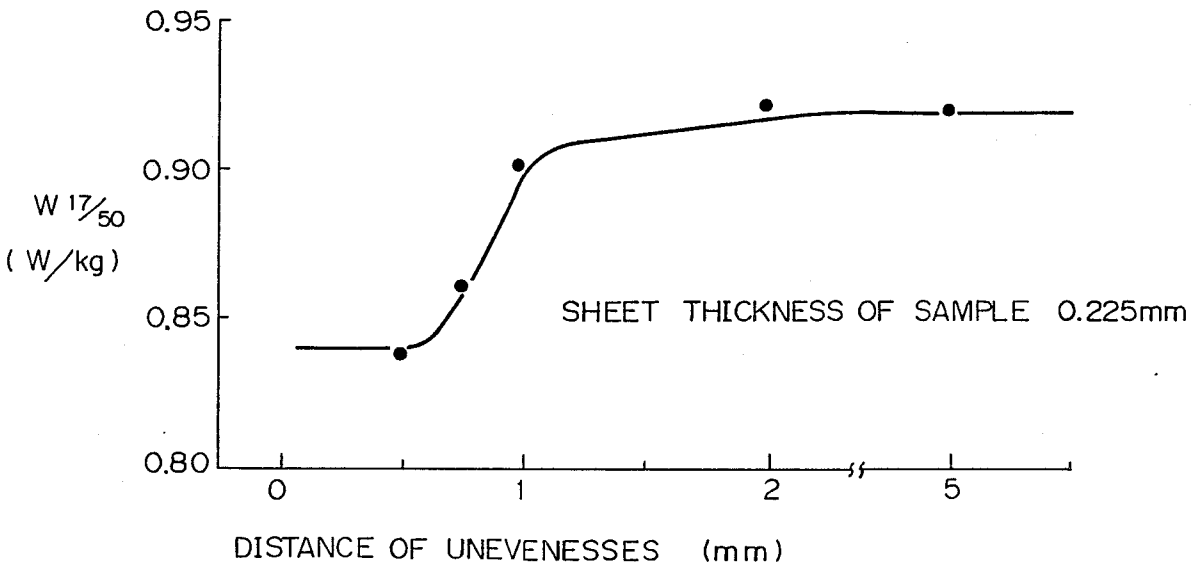
FIG. 5 illustrates the influence of the distance between the unevennesses formed on a steel sheet upon the watt loss.

FIG. 5 shows that sharp and minute unevennesses formed at a distance of less than 1 mm, preferably less than 0.5 mm, are advantageous for reducing the watt loss. The adhesivity of a glass film is also enhanced when the distance between the unevennesses is less than 1 mm. The distance is between the adjacent convex parts of the unevenesses.

Figure 6A:
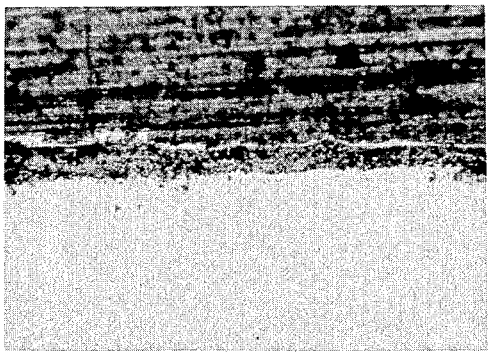
FIGS. 6(A) and (B) are similar photographs to those shown in FIGS. 1(A) and 1(B), respectively, with regard to the effect of activation by polishing and light pickling.
Figure 6B:
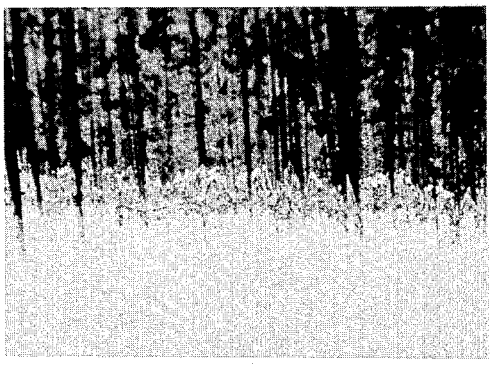
Figure 7:
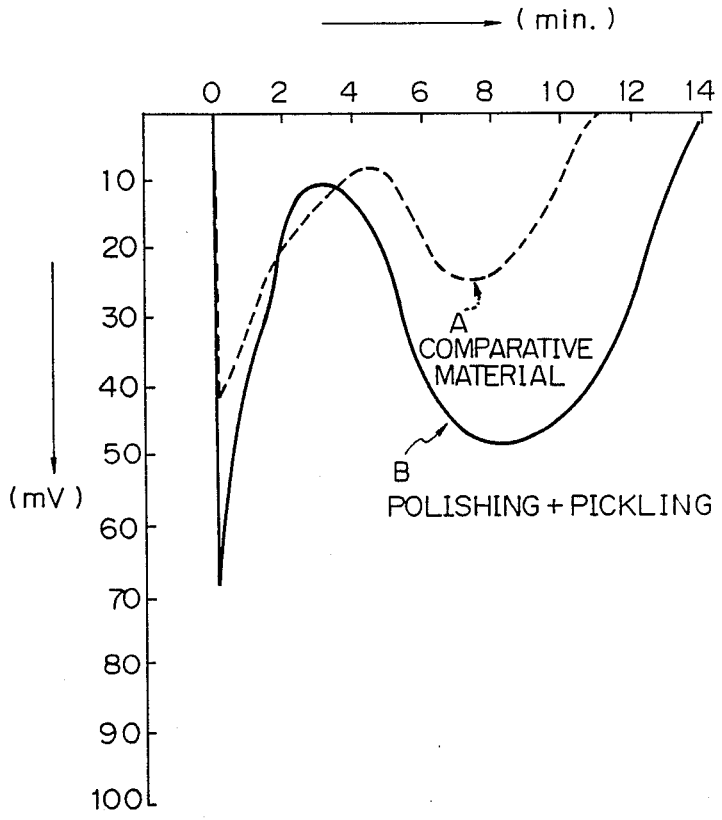
FIG. 7 is a drawing of curves of the potential of oxide films in a dilute sulfuric acid.

In an experiment by the present inventors, coldrolled steel sheets of a grain-oriented electrical steel sheet, which were cold-rolled to a final thickness of 0.30 mm, were polished by a brush roll having abrasive grains embedded therein. The average roughness Ra and maximum roughness $R_T$ were 0.5 μm and 4.5 μm, respectively. Subsequently, light pickling by a dilute sulfuric acid was carried out to attain a weight loss of approximately 1 g/m$^2$, and activate the surfaces of the steel sheets. These steel sheets were decarburization annealed at 850° C. in an $N_2+H_2$ wet atmosphere having a P $H_2O$/P $H_2$ of 0.4. The annealing separator mainly composed of MgO was then applied and finishing annealing at 1200° C. for 20 hours carried out. FIG. 6(A) shows the inner oxide layer of the comparative sample, which has not been polished and lightly pickled. The inner oxide layer of the comparative sample is virtually uniformly thick. The inner oxide layer of the sample shown in FIG. 6(B) has a thickness such that parts thereof are thicker than the average thickness and protrude into the steel sheet part. FIG. 7 shows the solution curves (potential curve) of oxide films on the decarburization annealed sheets in dilute sulfuric acid. As shown in FIG. 7 for the material B treated by polishing and then light pickling (activated), the potential peak corresponding to the $SiO_2$ layer is high, which indicates that a thick $SiO_2$ layer has been formed.

Table 1 shows the magnetic properties of grain-oriented electrical steel sheets treated by the different processes.

TABLE 1

| No. | Treating Conditions | Magnetic Properties $B_{10}$ (T) | Magnetic Properties $W_{17/50}$ (W/kg) | Tension of Glass Film (kg/mm$^2$) |
|---|---|---|---|---|
| 1 | Brush Polishing | 1.940 | 0.96 | 0.58 |
| 2 | Brush Polishing + Light Pickling | 1.937 | 0.94 | 0.62 |
| 3 | Comparative Material (without treatment) | 1.946 | 1.02 | 0.30 |

The amount removed by light pickling is preferably 2.5 g/m$^2$ or less. When the amount removed exceeds 2.5 g/m$^2$, the pickling is so severe that the surface of the steel sheet is roughened, and further, the sharp and minute unevenness formed by a mechanical means or the like are deformed. In this case, the unevennesses do not have the function of forming sharp oxide protrusions.

The depth of the unevennesses is preferably from 0.3 to 5 μm, in terms of the average roughness Ra, and approximately 15 μm in terms of the maximum roughness $R_T$.

Prior or subsequent to the decarburization annealing, preferably strain is imparted to a steel sheet by laser irradiation, marking off, a knife, or a tooth form roll. The distance between the strained regions is preferably from approximately 1 to 20 mm, and the angle of the strained regions relative to the rolling direction is preferably from 30 to 90 degrees. The strain, in combination with the activation of the surface of the steel sheet due to sharp and minute strains, contributes to a further reduction of the watt loss.

The direction of, for example, polishing for forming the sharp and minute unevenness, is not limited in any way.

The processes for producing the grain-oriented electrical steel sheet according to the present invention are described hereinafter.

The steel composition of a grain-oriented electrical steel sheet and production conditions until cold-rolling need not be specified since they are well known. The steels used may contain from 0.04 to 0.10% of C and from 2.0 to 4.0% of Si. Any adequate inhibitors, such as AlN, MnS, MnSe, BN, $Cu_2S$, and the like, may be used. If necessary, elements such as Cu, Sn, Cr, Ni, Mo, Sn, and the like may be added.

Note, conventional industrially produced grain-oriented electrical steel sheets had a thickness of 0.30 mm, but 0.23 mm, 0.20 mm, 0.175 mm, and 0.150 mm thick grain-oriented electrical steel sheets have been developed and are now produced, to reduce the eddy current loss. One of the greatest hindrances to the production of thin grain-oriented electrical steel sheets is the instability of the secondary recrystallization. Japanese Unexamined Patent Publication (Kokai) No. 58-217630 proposed the addition of Sn and Cu for stabilizing the secondary recrystallization, and Japanese Unexamined Patent Publication proposed predecarburization annealing. In the present invention, however, the secondary recrystallization of 0.23 mm or less thin grain-oriented electrical steel sheets is advantageously stabilized.

After the cold-rolling for obtaining the final thickness, decarburization annealing is carried out.

Preferably, the decarburization annealing promotes the decarburization and oxidation reaction. This is attained by enhancing the dew point, for example, from 60° to 70° C., in the presence of a 25% $N_2$+75% $H_2$ atmosphere at 850° C.

In an experiment by the present inventors, the surfaces of cold-rolled sheets of a grain-oriented electrical steel, which were cold-rolled to a final thickness of 0.225 mm, were polished by sheets of sand paper having different grades to form sharp and minute unevennesses. Subsequently, decarburization. annealing was carried out at 850° C. in an $N_2+H_2$ atmosphere while varying the P $H_2O$/P $H_2$ ratio to 0.30, 0.40, and 0.50. Subsequently, an annealing separator composed mainly of MgO was applied and the finishing annealing was then carried out.

Figure 8:
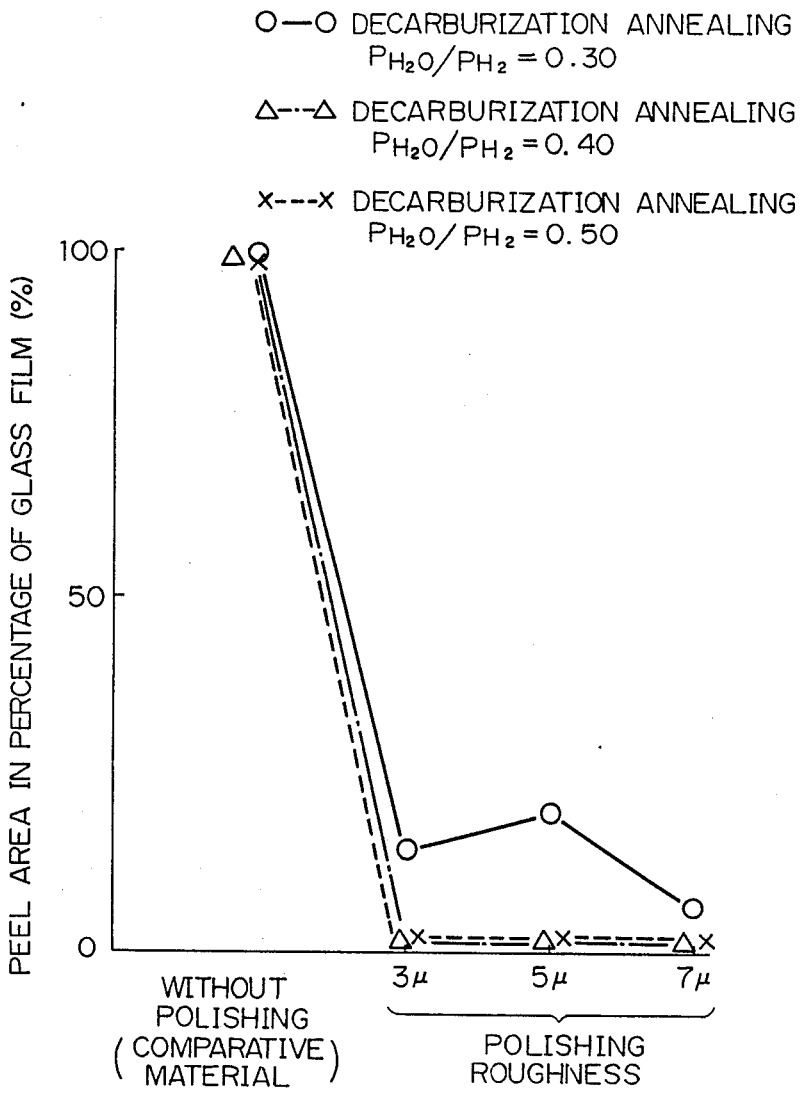
FIG. 8 illustrates the influence of polishing the roughness of a steel sheet surface and decarburization annealing-conditions upon the adhesiveness of a glass film.
Figure 9:
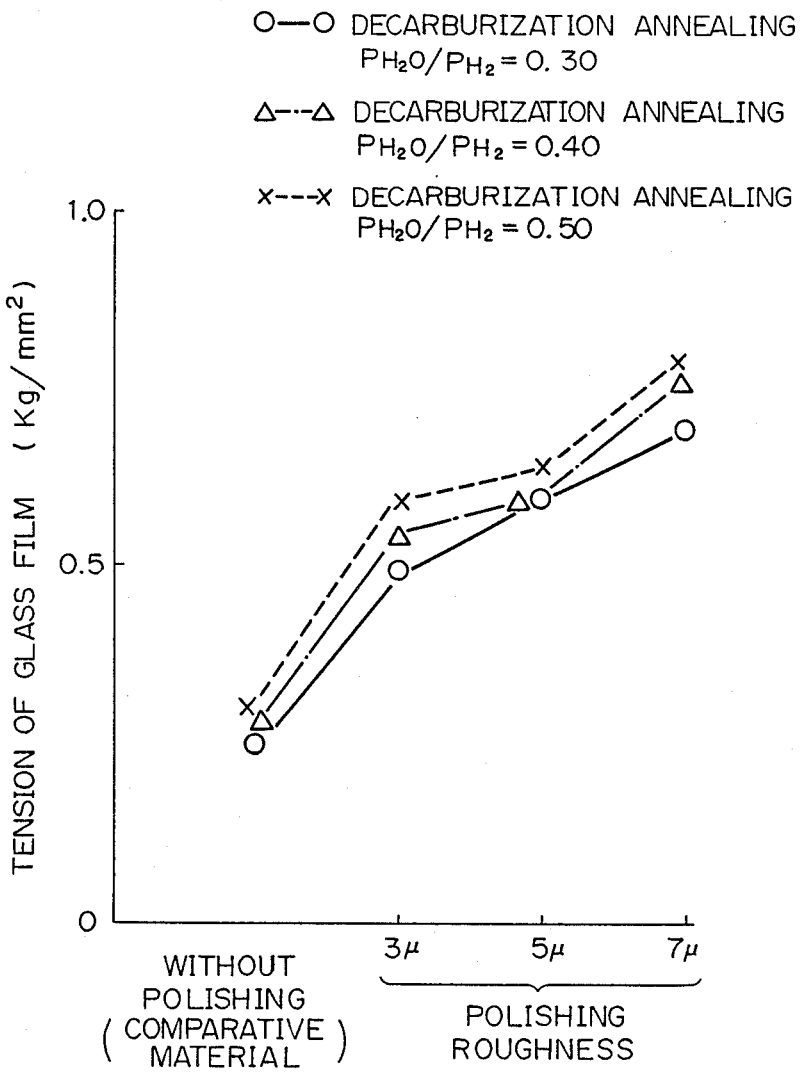
FIG. 9 illustrates the influence of polishing the roughness of a steel sheet surface and decarburization annealing-conditions upon the tension of a glass film.
Figure 10:
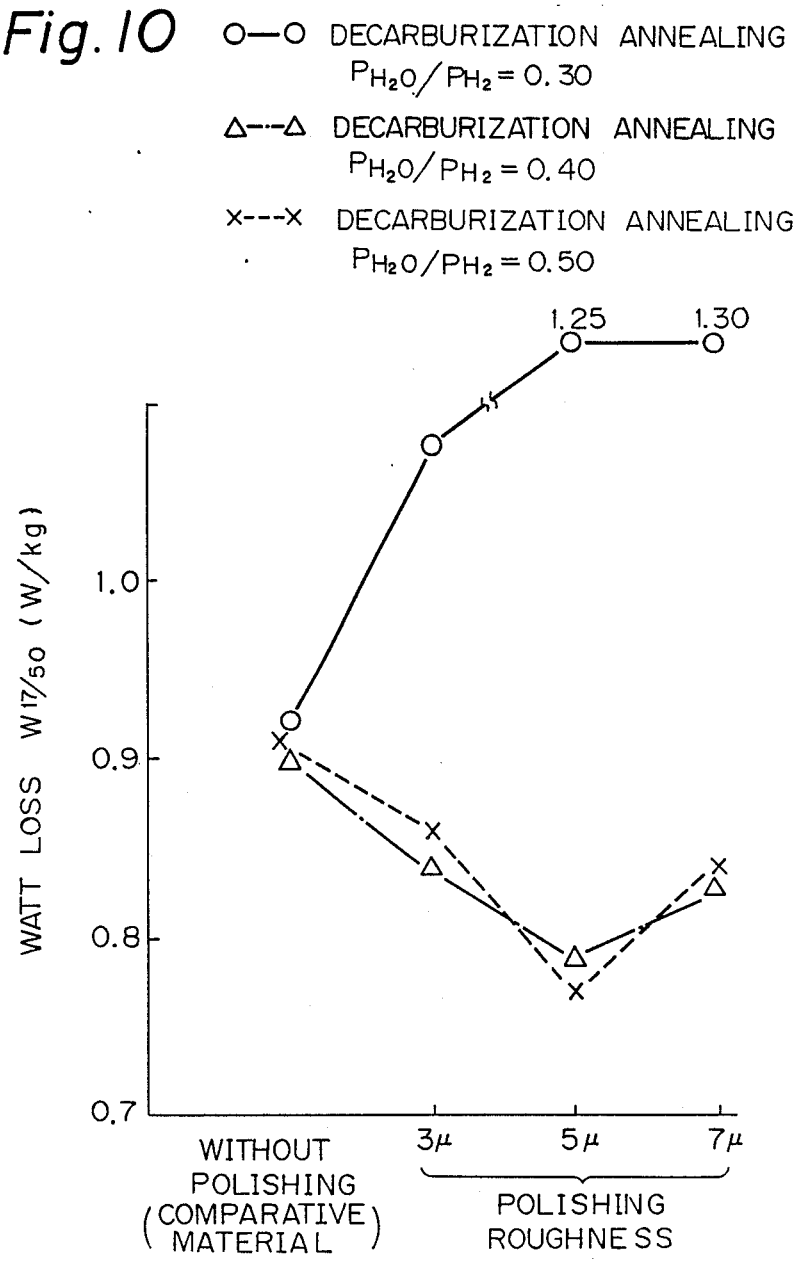
FIG. 10 illustrates the influence of polishing the roughness of a steel sheet surface and decarburization annealing-conditions upon the watt loss.

Referring to FIG. 8, oxide peeling does not occur in the samples which are decarburization-annealed at a P $H_2O$/P $H_2$=0.40 and 0.50. Polishing has a tendency to considerably enhance the tension of a film, as shown in FIG. 9, and the watt loss is improved considerably at a P $H_2O$/P $H_2 \geqq 0.40$, but is degraded when compared with the an unpolished sample at a P $H_2O$/P $H_2 < 0.40$, as shown in FIG. 10.

After the decarburization annealing, an annealing separator, which is mainly composed of MgO and in which additives, $TiO_2$, B compounds, such as $H_3BO_3$, $Na_2B_4O_7$, and the like, SrS, SnS, CuS, and the like are added, is applied and dried.

The finishing annealing is then carried out, and the oxide, having a thickness exceeding the average thickness and partially protruding into the steel sheet side, and the annealing separator are caused to react with each other, and thus a glass film is formed. The glass film is contiguous to the oxide which partially deeply protrudes into the steel sheet side. Alternatively, the glass film per se deeply protrudes into the steel sheet side. Therefore, the adhesiveness of the glass film is considerably enhanced, and furthermore, the tension which the glass film imparts to the steel sheet is drastically enhanced, to obtain steel sheets having an extremely low watt loss. The secondary recrystallization is satisfactory even in thin material, for example, 0.15 mm thick material, because the decomposition and disappearance of the inhibitors is suppressed due to the shielding effect of the oxide formed in the decarburization annealing.

Subsequently, a flattening annealing is carried out, and then an insulating coating solution, which contains one or more of phosphoric acid, phosphates, such as aluminum phosphate, magnesium phosphate, zinc phosphate, and calcium phosphate, chromic acid, chromates, such as magnesium chromate and the like, bichromates, and colloidal silica, is applied on the steel sheet, followed by baking at temperature of 350° C. or more to form an insulating film. The advantages of the present invention will be further clarified by the following examples, which in no way limit the present invention.

EXAMPLE 1

A silicon steel-slab containing 0.060% of C, 2.95% of Si, 0.070% of Mn, 0.029% of Al, 0.025% of S, and a balance of iron was subjected, by a known method, to hot-rolling, annealing, and cold-rolling to obtain 0.27 mm thick sheets. On the sheets, sharp and minute unevennesses were formed in a direction perpendicular to the rolling direction, with a distance of 0.8 mm or less and 5 mm and an average roughness of 0.5 μm and 2.0 μm, by brush rolling and buff polishing.

Then, decarburization annealing was carried out at 850° C. for 120 seconds in an $N_2+H_2$ humid atmosphere (P $H_2O$/P $H_2$=0.40). Subsequently, the application of an annealing separator, and a finishing annealing at 1200° C. for 20 hours, were carried out. The glass film properties and the magnetic properties in this state were as shown in Table 2.

TABLE 2

| Treatment Conditions | | Magnetic Properties | | Glass Film | |
|---|---|---|---|---|---|
| Method | Average Roughness | (T) $B_{10}$ | (W/kg) $W_{17/50}$ | 10 mmϕ Adhesivity (Bending) | Tension of Glass Film (kg/mm²) |
| Brush | 0.5 μm | 1.929 | 0.94 | Slight peel | 0.48 |
| Rolls | 2.0 μm | 1.922 | 0.92 | No peel at all | 0.60 |
| Buff | 0.5 μm | 1.925 | 0.92 | Slight peel | 0.45 |
| Polishing | 2.0 μm | 1.920 | 0.93 | No peel at all | 0.62 |
| Comparative Material 1 (Without Polishing) | | 1.938 | 0.98 | Peel on entire surface | 0.28 |
| Comparative Material 2 (Distance between Convex and Concave −5 mm) | | 1.937 | 0.97 | Peel on entire surface | 0.26 |

As is apparent from Table 2, according to the present invention, grain-oriented electrical steel sheets having a high film tension, an improved adhesiveness, and a low watt loss were obtained.

EXAMPLE 2

A silicon steel-slab containing 0.070% of C, 3.23% of Si, 0.075% of Mn, 0.025% of Al, 0.026% of S, and balance of iron was subjected, by a known method, to hot-rolling, annealing, and cold-rolling to obtain 0.30 mm thick sheets. The surface of the cold-rolled sheets was polished by a brush-roll with an embedded polishing grindstones to obtain an average surface roughness of 1.0 μm. Several of the sheets were further subjected, after the polishing treatment, to a light pickling treatment by 5% sulfuric acid, while varying the weight loss due to pickling.

Then, decarburization annealing was carried out at 850° C. in an $N_2+H_2$ humid atmosphere (P $H_2O$/P $H_2$=0.38), and subsequently, the application of an annealing separator, and a finishing annealing at 1200° C. for 20 hours, were carried out. The glass film properties and magnetic properties in this state were as shown in Table 3.

TABLE 3

| Treatment Conditions | | Magnetic Properties | | Glass Film | | |
|---|---|---|---|---|---|---|
| Polishing depth | Weight Loss by Pickling (g/m²) | $W_{17/50}$ | $B_{10}$ | Appearance | Tension of Glass Film | Adhesivity |
| −μm | — | 0.930 | 1.928 | Slight Non-uniformity | 0.25 kg/mm² | Δ |
| 1.0 | none | 0.885 | 1.935 | Uniform and | 0.46 | ◎ |

TABLE 3-continued

| Treatment Conditions | | Magnetic Properties | | Glass Film | | |
|---|---|---|---|---|---|---|
| Polishing depth | Weight Loss by Pickling (g/m²) | $W_{17/50}$ | $B_{10}$ | Appearance | Tension of Glass Film | Adhesivity |
| 1.0 | none | 0.850 | 1.933 | Excellent Uniform and Excellent | 0.58 | O |
| 1.0 | none | 0.852 | 1.925 | Uniform and Excellent | 0.60 | O |
| 1.0 | 0.5 | 0.870 | 1.943 | Uniform and Excellent | 0.50 | O |
| 1.0 | 1.0 | 0.836 | 1.937 | Uniform and Excellent | 0.62 | O |
| 1.0 | 2.0 | 0.835 | 1.930 | Uniform and Excellent | 0.62 | O |

Remarks: Adhesivity - Bending around 10 mmϕ after coating an insulating coating

As is apparent from Table 3, according to the present invention, grain-oriented electrical steel sheets having a high film tension, an improved adhesiveness, and a low watt loss are obtained.

EXAMPLE 3

A silicon steel-slab containing 0.065% of C, 3.25% of Si, 0.068% of Mn, 0.027% of Al, 0.023% of S, 0.07% of Cu, 0.12% of Sn, and a balance of iron was subjected, by a known method, to hot-rolling, annealing, and cold-rolling to obtain 0.225 mm thick sheets. Note, sheets which were not further subjected to a polishing-treatment are designated as "without treatment". An area of 50% of the steel sheets was polished by sand paper, while varying the grade thereof, to form unevennesses in terms of 12 μm, 9 μm, 7 μm, 5 μm, and 3 μm of the surface roughness of the steel sheet.

Then, the processes of decarburization annealing, application of an annealing separator, and finishing annealing were carried out, and subsequently, product sheets were obtained by heat-flattening after the application of an insulating coating. The properties of the films and the magnetic properties of the product sheets were then measured and the results were as shown in Table 3. Note, an investigation of the adhesiveness of the films under an ordinary condition of bending to around 20~50 mmϕ revealed that no peeling occurred even for materials that were "without treatment". Accordingly, a more severe bending to 10 mmϕ was carried out.

TABLE 4

| | Surface Roughness (μm) | Magnetic Properties $W_{17/50}$ (W/kg) | $B_{10}$ (T) | Adhesivity of Film (%) |
|---|---|---|---|---|
| 1 | 3 | 0.87 | 1.94 | 20 |
| 2 | 5 | 0.80 | 1.94 | 3 |
| 3 | 7 | 0.79 | 1.93 | 0 |
| 4 | 9 | 0.83 | 1.92 | 0 |
| 5 | 12 | 0.88 | 1.92 | 0 |
| 6 | Comparative Material (without treatment) | 0.91 | 1.93 | 75 |

Remarks: Area percentage of a film peeled by bending around 10 mmϕ.

EXAMPLE 4

A silicon steel-slab containing 0.060% of C, 3.15% of Si, 0.070% of Mn, 0.030% of Al, 0.024% of S, 0.07% of Cu, 0.13% of Sn, and a balance of iron was subjected, by a known method, to hot-rolling, annealing, and cold-rolling to obtain 0.29 mm thick sheets. An area of 80% of the steel sheets was treated by square shot-blasting to form unevennesses from 25 to 10 μm in depth.

Then, the processes of decarburization annealing, application of an annealing separator, and finishing annealing were carried out, and subsequently, the product sheets were obtained by heat-flattening after the application of an insulating coating. The properties of the films and the magnetic properties of the product sheets were measured, and the results were as shown in Table 5.

TABLE 5

| | Indentation by Shot Treatment (μm) | Magnetic Properties $W_{17/50}$ (W/kg) | $B_{10}$ (T) | Adhesivity of Film (%) |
|---|---|---|---|---|
| 1 | 2.5 | 0.97 | 1.94 | 20 |
| 2 | 5 | 0.95 | 1.95 | 5 |
| 3 | 7.5 | 0.94 | 1.94 | 0 |
| 4 | 10 | 0.97 | 1.93 | 0 |
| 5 | Comparative Material (without treatment) | 1.04 | 1.94 | 70 |

Remarks: Area percentage of a film peeled by bending around 10 mmϕ.

EXAMPLE 5

A silicon steel-slab containing 0.058% of C, 3.10% of Si, 0.065% of Mn, 0.0010% of Al, 0.024% of S, and balance of iron was subjected to a well known double rolling method to obtain 0.265 mm thick steel sheets. Samples of these sheets were designated as "without treatment". An area of approximately 70% of the steel sheets was polished by a brush roll, to form unevennesses in terms of 3~4 μm, 8~10 μm, and 12~15 μm of the surface roughness of the steel sheet. Then, the processes of decarburization annealing, application of an annealing separator, and finishing annealing were carried out, and subsequently, the product sheets were obtained by heat-flattening after the application of an insulating coating. The properties of the films and the magnetic properties of the product sheets were measured, and the results were as shown in Table 6.

TABLE 6

| | Brush Roll Treatment Conditions (Treatment Depth: μm) | Magnetic Properties $W_{17/50}$ (W/kg) | $B_{10}$ (T) | Adhesivity of Film (%) | Tension of Glass film (kg/cm²) |
|---|---|---|---|---|---|
| 1 | 3~4 | 1.10 | 1.87 | 10 | 0.48 |
| 2 | 5~6 | 1.12 | 1.86 | 0 | 0.52 |
| 3 | 8~10 | 1.15 | 1.85 | 0 | 0.60 |
| 4 | 12~15 | 1.18 | 1.85 | 0 | 0.65 |
| 5 | Comparative Material | 1.20 | 1.86 | 60 | 0.35 |

TABLE 6-continued

| Brush Roll Treatment Conditions (Treatment Depth: μm) | Magnetic Properties $W_{17/50}$ (W/kg) | Magnetic Properties $B_{10}$ (T) | Adhesivity of Film (%) | Tension of Glass film (kg/cm²) |
|---|---|---|---|---|
| (without treatment) | | | | |

Remarks: Area percentage of a film peeled by bending around 10 mmϕ.

EXAMPLE 6

The 0.225 mm thick cold-rolled steel sheets prepared in the same manner as in Example 3 were decarburization-annealed at 850° C. for 3 minutes in an $N_2+H_2$ humid atmosphere. An area of approximately 50% of the decarburization-annealed steel sheets was polished, by a brush roll, to form unevennesses in terms of 12~15 μm, 8~10 μm, 4~6 μm, and 2~3 μm of the surface roughness of the steel sheet.

Subsequently, with regard to the samples that were decarburization-annealed alone and the samples decarburization-annealed and then polished, the application of an annealing separator and then finishing annealing at 1200° C. for 20 hours were carried out and subsequently, the product sheets were obtained by heat-flattening after the application of an insulating coating. The properties of the films and the magnetic properties of the product sheets were measured, and the results were as shown in Table 7.

TABLE 7

| No. | Surface Roughness (μm) | Magnetic Properties $W_{17/50}$ (W/kg) | Magnetic Properties $B_{10}$ (T) |
|---|---|---|---|
| 1 | 2~3 | 0.84 | 1.95 |
| 2 | 4~6 | 0.77 | 1.93 |
| 3 | 8~10 | 0.79 | 1.92 |
| 4 | 12~15 | 0.83 | 1.92 |
| 5 | Comparative Material (without treatment) | 0.92 | 1.95 |

EXAMPLE 7

A silicon steel-slab containing 0.080% of C, 3.20% of Si, 0.065% of Mn, 0.035% of Al, 0.024% of S, 0.060% of Cu, 0.11% of Sn, and a balance of iron was subjected, by a known method, to hot-rolling, annealing, and cold-rolling to obtain 0.225 mm thick sheets. Sheets which were not polished are designated as "without treatment". The steel sheets were polished, while varying the area percentage of the parts polished to 20%, 50%, 70%, and 95%, by sand paper, to form unevennesses in terms of 5 μm of the surface roughness of the steel sheet. The steel sheets were then decarburization-annealed in an $N_2+H_2$ humid atmosphere, and subsequently, the application of an annealing separator, in which 6.5 parts by weight of $TiO_2$ was blended with respect to 100 parts by weight of MgO, and then finishing annealing at 1200° C. for 20 hours, were carried out.

The properties of the films and the magnetic properties were then measured, and the results were as shown in Table 8.

TABLE 8

| No. | Area Percentage of Polished Parts (%) | Properties of Glass Film: Appearance | Tension (kg/mm²) | Adhesivity (10 mmϕ Bending) | Magnetic Properties $W_{17/50}$ (W/kg) | Magnetic Properties $B_{10}$ (T) |
|---|---|---|---|---|---|---|
| 1 | 20 | Slightly thin, Nonuniformity like Gas Marks | 0.26 | Δ | 0.95 | 1.93 |
| 2 | 50 | Uniform, thick and excellent | 0.48 | O | 0.88 | 1.92 |
| 3 | 70 | Uniform, thick and excellent | 0.55 | O | 0.85 | 1.92 |
| 4 | 95 | Uniform, thick and excellent | 0.58 | O | 0.85 | 1.91 |
| 5 | 0 (Comparative Material) | Slightly thin, Nonuniformity like Gas Marks | 0.25 | x | 0.97 | 1.94 |

Remarks: Criterion of Adhesivity
⊙: No peeling
Δ: Peeling occurrence at area of 20~50%
x: Peeling occurrence at area of 50% or more

EXAMPLE 8

Cold-rolled steel sheets 0.18 mm thick were prepared and decarburization-annealed in the same manner as in Example 7. The decarburization-annealed steel sheets were then polished, while varying the area percentage of the polished parts to 15%, 50%, 80%, and 95%, by a brush roll, to form polished parts 3 μm in depth. Subsequently, the application of an annealing separator, in which 6.5 parts by weight of $TiO_2$ was blended with respect to 100 parts by weight of MgO, and then finishing annealing at 1200° C. for 20 hours, were carried out. The properties of the films and the magnetic properties were then measured, and the results were as shown in Table 9.

TABLE 9

| No. | Area Percentage of Polished Parts (%) | Properties of Glass Film: Appearance | Tension (kg/mm²) | Adhesivity (10 mmϕ Bending) | Magnetic Properties $W_{17/50}$ (W/kg) | Magnetic Properties $B_{10}$ (T) |
|---|---|---|---|---|---|---|
| 1 | 15 | Slightly thin, Nonuniformity | 0.30 | Δ | 0.92 | 1.93 |

TABLE 9-continued

| No. | Area Percentage of Polished Parts (%) | Properties of Glass Film: Appearance | Tension (kg/mm²) | Adhesivity (10 mmϕ Bending) | Magnetic Properties: $W_{17/50}$ (W/kg) | $B_{10}$ (T) |
|---|---|---|---|---|---|---|
| | | like Gas Marks | | | | |
| 2 | 50 | Uniform and excellent | 0.42 | ○ | 0.82 | 1.93 |
| 3 | 80 | Uniform and excellent | 0.48 | ◎ | 0.82 | 1.92 |
| 4 | 95 | Uniform and excellent | 0.48 | ◎ | 0.80 | 1.90 |
| 5 | 0 (Comparative Material) | Slightly thin, Nonuniformity like Gas Marks | 0.28 | x | 0.93 | 1.93 |

EXAMPLE 9

A silicon steel-slab containing 0.078% of C, 3.28% of Si, 0.065% of Mn, 0.033% of Al, 0.023% of S, 0.070% of Cu, 0.10% of Sn, and a balance of iron was subjected, by a known method, to hot-rolling, annealing, and cold-rolling to obtain 0.30 mm thick sheets. Sheets which were not polished are designated as "without treatment". Two surface activation treatments were carried out, as follows: samples of the steel sheets were polished, while varying the area percentage of the polished parts to 50%, and 85%, by sand paper, to form polished parts 3 μm in roughness, and in addition to these samples, polished and marked-off samples were prepared by treatment by a knife edge to introduce 10 μm deep strains at a distance of 5 mm and in a direction perpendicular to the rolling direction. The steel sheets were then decarburization-annealed in a humid atmosphere, and subsequently, the application of an annealing separator, and then finishing annealing at 1200° C. for 20 hours, were carried out.

The properties of the films and the magnetic properties were then measured, and the results were as shown in Table 10.

TABLE 10

| No. | Conditions for Surface Activation: Polishing | Marking Off | Properties of Glass Film: Appearance | Adhesivity (10 mmϕ Bending) | Tension (kg/mm²) | Magnetic Properties: $B_{10}$ (T) | $W_{17/50}$ (W/kg) |
|---|---|---|---|---|---|---|---|
| 1 | 3μ 50% | No | Thick, uniform, excellent | ◎ | 0.53 | 1.93 | 0.98 |
| 2 | 3μ 50% | Yes | Thick, uniform, excellent | ◎ | 0.52 | 1.93 | 0.95 |
| 3 | 3μ 85% | No | Thick, uniform, excellent | ◎ | 0.56 | 1.92 | 0.99 |
| 4 | 3μ 85% | Yes | Thick, uniform, excellent | ◎ | 0.56 | 1.92 | 0.92 |
| 5 | No (Comparative Material) | No | Slightly thin, Nonuniformity like Gas Marks | Δ | 0.25 | 1.94 | 1.03 |

Remarks: Criterion of Adhesivity
◎: No peeling
○: Peeling occurrence at area of 50% or less
Δ: Peeling occurrence at area of 20~50%

In all of the samples on which surface sharp and minute unevennesses were formed, the film and magnetic properties were improved, and a further improvement in the watt loss was recognized in the samples which were further subjected to the strain-introduction by a knife.

EXAMPLE 10

A silicon steel-slab containing 0.073% of C, 3.20% of Si, 0.065% of Mn, 0.030% of Al, 0.024% of S, 0.075% of Cu, 0.11% of Sn, and a balance of iron was subjected, by a known method, to hot-rolling, annealing, and cold-rolling to obtain 0.225 mm thick sheets. The steel sheets were polished, while varying the area percentage of the polished parts to 60%, and 90%, by a brush roll, to form polished parts 3 μm in depth. Decarburization annealing was then carried out in an $N_2+H_2$ humid atmosphere, and then, by using a marking-off needle, marking-off in a direction perpendicular to the rolling direction was carried out at a distance of 5 mm, so as to introduce the strain. Subsequently the application of an annealing separator, and finishing annealing were carried out, and subsequently, the product sheets were obtained by heat-flattening after the application of an insulating coating. The properties of the films and the magnetic properties of the product sheets were measured, and the results were as shown in Table 11.

TABLE 11

| No. | Conditions of Polishing after Cold-Rolling | Marking-off after Decarburization | Properties of Glass Film: Appearance | Adhesivity (10 mmϕ Bending) | Tension (kg/mm²) | Magnetic Properties: $B_{10}$ (T) | $W_{17/50}$ (W/kg) |
|---|---|---|---|---|---|---|---|
| 1 | 3μ 60% | No | Uniform, thick and excellent | | 0.52 | 1.92 | 0.88 |
| 2 | 3μ | Yes | Uniform, thick | | 0.50 | 1.91 | 0.78 |

TABLE 11-continued

| No. | Conditions of Polishing after Cold-Rolling | Marking-off after Decarburization | Properties of Glass Film: Appearance | Adhesivity (10 mmϕ Bending) | Tension (kg/mm²) | Magnetic Properties: $B_{10}$ (T) | $W_{17/50}$ (W/kg) |
|---|---|---|---|---|---|---|---|
| 3 | 60% 3μ | No | and excellent Uniform, thick | O | 0.58 | 1.92 | 0.85 |
| 4 | 90% 3μ | Yes | and excellent Uniform, thick | O | 0.57 | 1.91 | 0.77 |
| 5 | 90% No (Comparative Material) | No | and excellent Slightly thin, Nonuniformity like Gas Marks | Δ | 0.28 | 1.94 | 0.93 |

As in Example 9, the polished samples exhibited improved film properties and magnetic properties. In the samples which were further subjected to the strain-introduction by a knife, a further improvement of the watt loss was obtained.

EXAMPLE 11

A silicon steel-slab containing 0.068% of C, 3.15% of Si, 0.070% of Mn, 0.028% of Al, 0.025% of S, and a balance of iron was subjected, by a known method, to hot-rolling, annealing, and cold-rolling to obtain 0.27 mm thick sheets. The steel sheets were treated by a knife edge to introduce 15 μm deep strains at a distance of from 5 mm to 20 mm and in a direction perpendicular to the rolling direction. The steel sheets were then decarburization-annealed in an $N_2+H_2$ wet atmosphere, and then activation was carried out by polishing with sand paper to form 2.5 μm deep polished parts over an area of 75%. Subsequently, the application of an annealing separator, and then finishing annealing at 1200° C. for 20 hours, were carried out. The properties of the films and the magnetic properties were then measured, and the results were as shown in Table 12.

TABLE 12

| No. | Strain-Introducing Treatment after Cold Rolling | Polishing Treatment after Decarburization | Properties of Glass Film: Adhesivity (10 mmϕ Bending) | Tension (kg/mm²) | Magnetic Properties: $B_{10}$ (T) | $W_{17/50}$ (W/kg) |
|---|---|---|---|---|---|---|
| 1 | No | Yes | O | 0.58 | 1.95 | 0.91 |
| 2 | Marking-off at a Distance of 5 mm | Yes | O | 0.60 | 1.94 | 0.86 |
| 3 | Marking-off at a Distance of 10 mm | Yes | O | 0.62 | 1.94 | 0.87 |
| 4 | Marking-off at a Distance of 20 mm | Yes | O | 0.58 | 1.94 | 0.89 |
| 5 | No (Comparative Material) | No | Δ | 0.28 | 1.95 | 0.97 |

The decarburization-annealed and then polished samples exhibited improved adhesiveness, film-tension, and magnetic properties. In the samples which were further subjected to strain-introduction by marking-off, a further improvement of the watt loss was obtained.

EXAMPLE 12

A silicon steel-slab containing 0.076% of C, 3.20% of Si, 0.072% of Mn, 0.026% of Al, 0.026% of S, and a balance of iron was subjected, by a known method, to hot-rolling, annealing, and cold-rolling, thereby finishing the slab to sheet thicknesses of 0.200 mm, 0.175 mm, 0.150 mm, and 0.125 mm. Samples were taken from the sheets having these thicknesses and several C were activated by sand paper having a grade of #100 to form sharp and minute unevennesses. The remaining sheets were not activated. With regard to the activated and non-activated samples, the decarburization-annealing, application of annealing separator, and finishing annealing were carried out. Further, the application of an insulating coating and a measurement of the magnetic properties were then carried out. Subsequently, after pickling, the macro-structure was observed. The results were as shown in Table 13.

TABLE 13

| Sheet Thickness (mm) | Polishing: Yes — Magnetic Flux Density $B_{10}$ (T) | Watt Loss $W_{17/50}$ (W/kg) | Ratio of Secondary Recrystallization (%) | None — Magnetic Flux Density $B_{10}$ (T) | Watt Loss $W_{17/50}$ (W/kg) | Ratio of Secondary Recrystallization (%) |
|---|---|---|---|---|---|---|
| 0.200 | 1.93 | 0.82 | 100 | 1.94 | 0.82 | 100 |
| 0.175 | 1.93 | 0.79 | 100 | 1.89 | 0.88 | 95 |
| 0.150 | 1.92 | 0.80 | 100 | 1.83 | 1.10 | 70 |

TABLE 13-continued

| Sheet Thickness (mm) | Polishing: Yes — Magnetic Flux Density $B_{10}$ (T) | Yes — Watt Loss $W_{17/50}$ (W/kg) | Yes — Ratio of Secondary Recrystallization (%) | None — Magnetic Flux Density $B_{10}$ (T) | None — Watt Loss $W_{17/50}$ (W/kg) | None — Ratio of Secondary Recrystallization (%) |
|---|---|---|---|---|---|---|
| 0.125 | 1.88 | 0.81 | 100 | 1.69 | 1.35 | 40 |

EXAMPLE 13

A silicon steel-slab containing 0.060% of C, 3.30% of Si, 0.065% of Mn, 0.030% of Al, 0.023% of S, 0.06% of Cu, 0.10% Sn, and a balance of iron was subjected, by a known method, to hot-rolling, annealing, and cold-rolling, to obtain 0.30 mm thick sheets. These sheets are designated as "before treatment". The steel sheets were polished, by sand paper, while varying the roughness thereof, to form polished, uneven parts 10 μm, 6 μm, and 3 μm in terms of surface roughness, over a 60% area of the steel sheets. Subsequently, decarburization-annealing of the sheets before treatment and of the polished sheets was carried out at 830° C. for 3 minutes in $N_2+H_2$ gas, while varying the P $H_2O$/P $H_2$ to 0.3, 0.4, 0.5, and 0.6. After the application of an annealing separator, the finishing annealing was carried out at 1200° C. for 20 hours. Subsequently, the product sheets were obtained by heat-flattening after the application of an insulating coating. The properties of the films and magnetic properties of the product sheets were measured, and the results were as shown in Table 14.

TABLE 14

| | Surface Roughness (μm) | Decarburization Annealing $P_{H2O}/P_{H2}$ | Magnetic Properties $B_{10}$ (T) | Magnetic Properties $W_{17/50}$ (W/kg) | Adhesivity of film (%) |
|---|---|---|---|---|---|
| 1 | 3 | 0.3 | 1.94 | 1.13 | 30 |
| 2 | | 0.4 | 1.93 | 0.95 | 3 |
| 3 | | 0.5 | 1.93 | 0.93 | 0 |
| 4 | | 0.6 | 1.94 | 0.93 | 0 |
| 5 | 6 | 0.3 | 1.93 | 1.20 | 25 |
| 6 | | 0.4 | 1.92 | 0.93 | 0 |
| 7 | | 0.5 | 1.93 | 0.90 | 0 |

TABLE 14-continued

| | Surface Roughness (μm) | Decarburization Annealing $P_{H2O}/P_{H2}$ | Magnetic Properties $B_{10}$ (T) | Magnetic Properties $W_{17/50}$ (W/kg) | Adhesivity of film (%) |
|---|---|---|---|---|---|
| 8 | | 0.6 | 1.92 | 0.91 | 0 |
| 9 | 10 | 0.3 | 1.91 | 1.18 | 25 |
| 10 | | 0.4 | 1.92 | 0.93 | 0 |
| 11 | | 0.5 | 1.91 | 0.88 | 0 |
| 12 | | 0.6 | 1.91 | 0.90 | 0 |
| 13 | 0 | 0.3 | 1.94 | 1.09 | 70 |
| 14 | (Comparative | 0.4 | 1.93 | 1.04 | 65 |
| 15 | | 0.5 | 1.93 | 1.03 | 65 |
| 16 | Material) | 0.6 | 1.93 | 1.03 | 60 |

Remarks: Area Percentage of a film peeled by bending around 10 mmϕ.

We claim:

1. A grain-oriented silicon steel sheet having areas of sharp and minute uneveness on at least one surface of the sheet, said areas having a depth of from 3 to 15 μm, said areas being separated from one another by less than 1 mm and said areas covering 50 percent to 90 percent of said surface of said sheet; an oxide layer disposed on said surface of said sheet and partially protruding into said areas of sharp and minute uneveness; and a glass film disposed over said oxide layer, said sheet having a watt loss of less than 0.082 $W_{17/50}$ (W/Kg) and said glass film having a tension of at least 0.6 Kg/mm$^2$.

2. A grain-oriented silicon steel sheet as recited in claim 1 wherein said areas are separated from one another by less than 0.5 mm.

3. A grain-oriented silicon steel sheet as recited in claim 1 wherein said areas have a depth of more than 3 μm.

4. A grain-oriented silicon steel sheet as recited in claim 2 wherein said areas have a depth of more than 3 μm.

5. A grain-oriented silicon steel sheet as recited in claim 1 wherein said oxide layer is silicon-enriched oxide.

* * * * *